United States Patent [19]

Gaber et al.

[11] Patent Number: 4,530,539

[45] Date of Patent: Jul. 23, 1985

[54] INFANT SEAT FOR CANTILEVERED MOUNTING ONTO A TABLETOP

[75] Inventors: Ira Gaber, W. Norwalk, Conn.; Harry E. Lawrence, III, Glen Ridge, N.J.

[73] Assignee: J. C. Penney Co., Inc., New York, N.Y.

[21] Appl. No.: 635,609

[22] Filed: Jul. 30, 1984

[51] Int. Cl.[3] ..... A47B 39/00

[52] U.S. Cl. ..... 297/174; 297/134

[58] Field of Search ..... 297/174, 130, 134, 217, 297/378, 53, 252, 349

[56] References Cited

U.S. PATENT DOCUMENTS

| | | | |
|---|---|---|---|
| D. 254,036 | 1/1980 | Euwema et al. | 6/9 |
| D. 263,769 | 4/1982 | Euwema et al. | 6/9 |
| 1,337,103 | 4/1920 | Straith . | |
| 2,489,084 | 11/1949 | Ducey . | |
| 2,707,987 | 5/1955 | Gibson . | |
| 3,082,035 | 3/1963 | Goolsby | 297/174 |
| 3,126,226 | 3/1964 | Johnson | 297/174 |
| 3,133,760 | 5/1964 | Robinson | 297/174 |
| 3,133,761 | 5/1964 | Ross | 297/174 |
| 3,222,104 | 12/1965 | Remington et al. | 297/174 |
| 3,253,860 | 5/1966 | Shapiro | 297/134 X |
| 3,449,012 | 6/1969 | Caron | 297/378 X |
| 4,248,478 | 2/1981 | Aron | 297/174 |
| 4,312,535 | 1/1982 | Smith | 297/174 |
| 4,322,110 | 3/1982 | Simmons et al. | 297/174 |
| 4,362,333 | 12/1982 | Cohen | 297/174 |

FOREIGN PATENT DOCUMENTS

| | | | |
|---|---|---|---|
| 244697 | 5/1963 | Australia | 297/174 |

*Primary Examiner*—James T. McCall
*Assistant Examiner*—José V. Chen
*Attorney, Agent, or Firm*—Daniel N. Calder

[57] ABSTRACT

An infant seat for cantilever mounting to a tabletop includes a pair of spaced-apart support members. Each support member is disposed on either side of the infant seat and includes a top portion adapted for contacting the upper surface of a tabletop, and a bottom portion adapted for contacting the under surface of a tabletop. When a baby is placed in the seat, the weight of the baby in cooperation with the top and bottom portions of the spaced-apart support members provides cantilever mounting of the seat to the tabletop. In addition, the infant seat includes a clamping support assembly which has a member projecting generally outwardly and upwardly as it extends from a forward side of a seat bottom. A telescoping member in association with a spring is capable of extensible and retractable movement from a distal end of the upwardly and outwardly projecting member. This telescoping member engages the under surface of a tabletop and in cooperation with the top portion of the spaced-apart members provides clamping support of the infant seat to the tabletop. Since the telescoping member can vary as it extends from or retracts into the outwardly and upwardly projecting member, it is self-adjusting in that it can accommodate tabletops having different thicknesses.

14 Claims, 6 Drawing Figures

FIG. 3
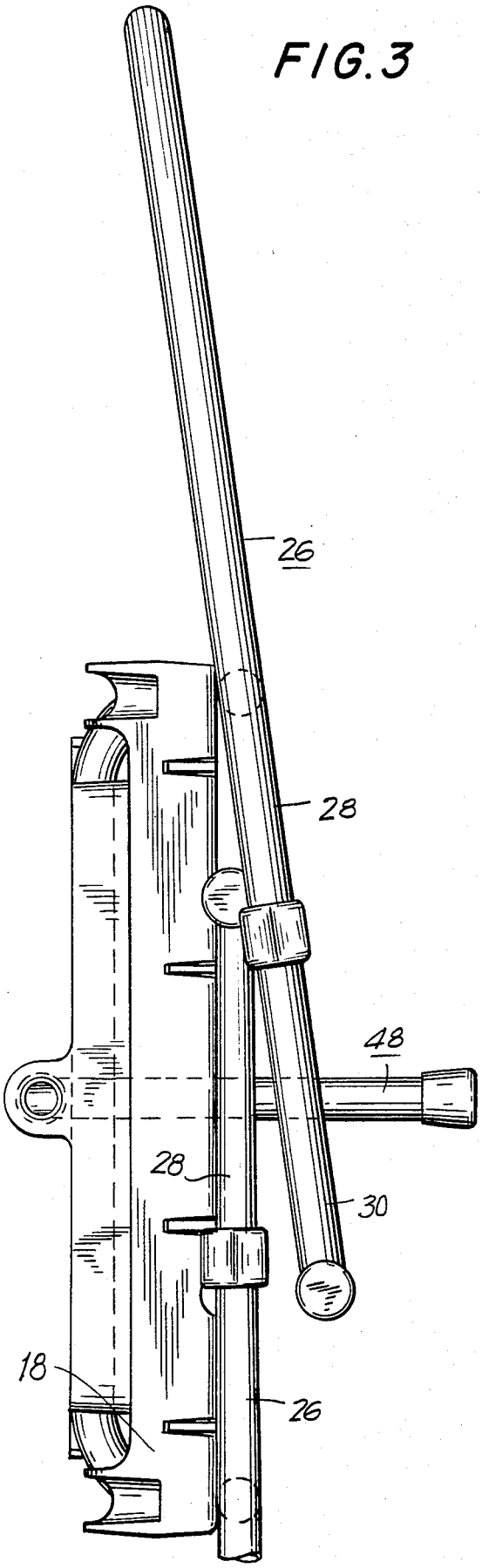
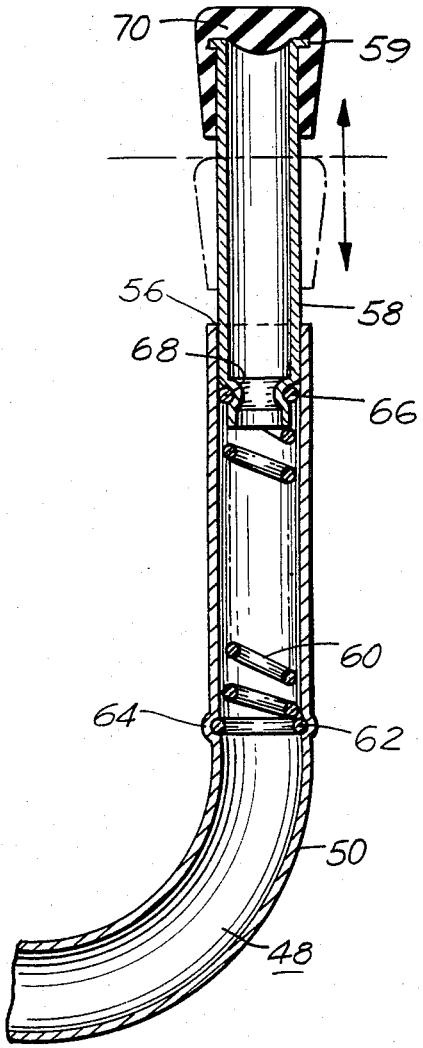
FIG. 6

INFANT SEAT FOR CANTILEVERED MOUNTING ONTO A TABLETOP

THE BACKGROUND OF THE INVENTION

The present invention relates to a portable infant seat, and more particularly, to an infant seat which can be cantilever mounted onto a tabletop and has additional means for providing clamping support to the tabletop.

Infant's seats which are self-supporting from a tabletop have been previously known. Many of these infant's seats are cantilever mounted to the table edge as shown in the following prior art: U.S. Pat. No. 4,362,333, to D. E. Cohen, issued Dec. 7, 1982; U.S. Pat. No. 4,322,110, to M. T. Simmons, et al., issued Mar. 30, 1982; U.S. Pat. No. 4,248,478, to L. Aron, issued Feb. 3, 1981; U.S. Pat. No. 3,222,104, to W. F. Remington, et al., issued Dec. 7, 1965; U.S. Pat. No. Des. 254,036, to G. J. Euwema, et al, issued Jan. 29, 1980; and U.S. Pat. No. Des. 263,769, to G. J. Euwema, et al., issued April 13, 1982.

These typical self-supporting infant seats slide over the edge of the tabletop and are mounted thereto by the cantilever action of the infant's weight in conjunction with the infant seat. However, a problem with this type of infant seat is that it relies substantially on the cantilever action to maintain its position on the tabletop. U.S. Pat. No. 4,312,535 to R. D. Smith, issued Jan. 26, 1982, takes this concept one step further and does provide some means for clamping the seat to the table. However, the clamping arms of Smith's infant seat are spaced-apart a fixed distance and may not readily accommodate various tabletops having different thicknesses.

Therefore, it is an object of the infant seat of the present invention to overcome the heretofore described deficiencies of the prior art.

A particular objective of the present invention is to provide an infant seat which is cantilever mounted to a tabletop, but also has means for clamping the infant seat to the tabletop irrespective of the tabletop's thickness.

These and other features and attendant advantages of the present invention will be more fully appreciated as the same becomes better understood from the following detailed description thereof.

SUMMARY OF THE INVENTION

The infant seat of the present invention is capable of cantilever mounting to a horizontally disposed tabletop and self-adjustable clamping to such tabletop. In particular, the infant chair includes a generally vertically oriented set back pivotally connected, at a lower side thereof, to a rear side of a generally horizontally oriented seat bottom. A pair of spaced-apart support members are provided. Each support member is integral in structure and has a top portion adapted as an upper support arm, and a bottom portion adapted as a lower support arm. The lower support arm is longer than the upper support arm. Each spaced-apart support member is adapted to engage a tabletop between its upper and lower support arms, with the lower support arm engaging an under surface of the tabletop while the upper support arm engages an upper surface of the tabletop. In this fashion the infant seat is cantilever mounted to the tabletop.

A first connector member is affixed to each of the upper support arms and is disposed downwardly therefrom. Second support members are affixed to and upwardly disposed from each of the lower support arms.

Each second connector member is axially aligned with a first connector member. In axial alignment with each aligned first and second connector members is a third connector member. The third connector member is in rotatable engagement with opposing ends of aligned first and second connector members.

A cross member extends between and is affixed to each third connector member. The seat bottom pivotally engages the cross member at a location on the seat bottom forward of its pivotable attachment to the seat back.

Also provided in the present invention is a clamping support arm assembly having a member projecting generally outwardly and upperwardly as it extends from a forward side of the seat bottom. Means are associated with said outwardly and upperwardly projecting member for self-adjustable engagement of the under surface of a tabletop. The self-adjustable means and the upper support arm are capable of engagement with their respective surfaces of the tabletop along a common plane extending perpendicular through the respective tabletop surfaces. The self-adjustable means is adapted to exert a force against the under surface of the tabletop. This force against the under surface of the tabletop in cooperation with the engagement of the upper support arm on the upper tabletop surface provides clamping engagement of the present invention to a tabletop.

BRIEF DESCRIPTION OF THE DRAWINGS

FIG. 3 is a top elevational view of the infant seat of FIG. 1 as folded for storing.

FIG. 6 is a cross-sectional view of the present invention as shown along lines 6—6 of FIG. 4.

DETAILED DESCRIPTION OF THE INVENTION

Figure 1:
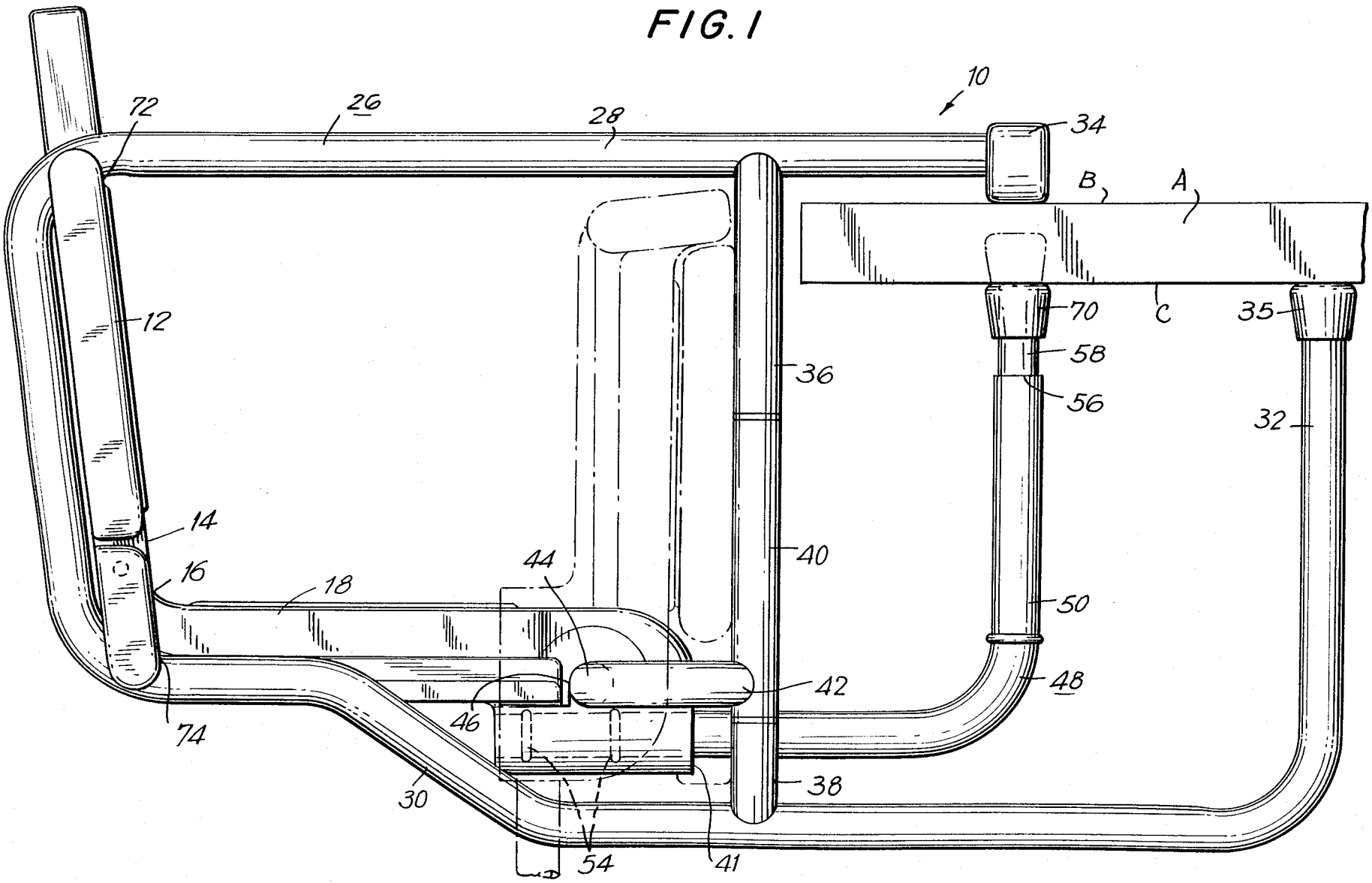
FIG. 1 is a side elevational view of the infant seat of the present invention as mounted to a tabletop.
Figure 2:
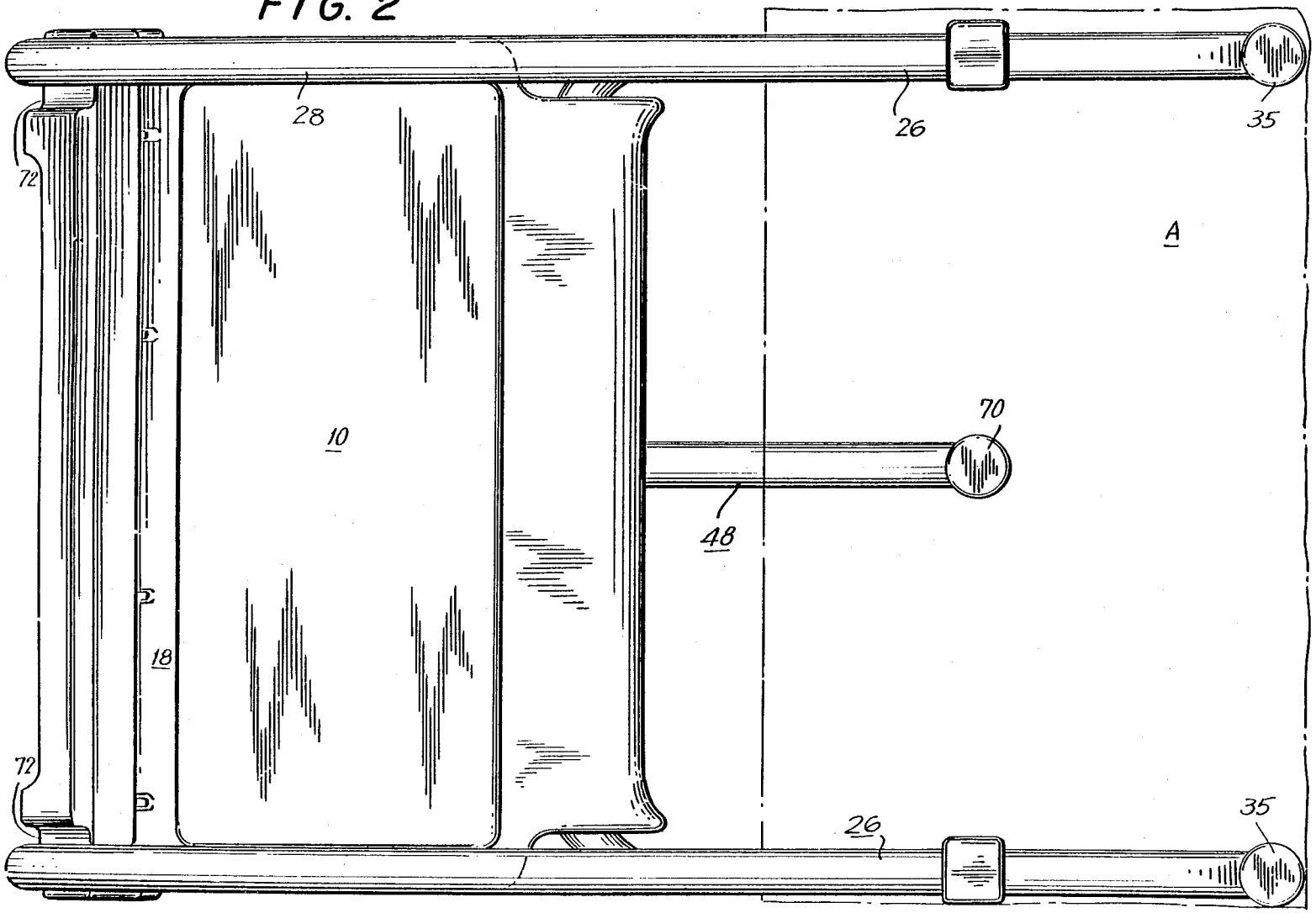
FIG. 2 is a top elevational view of the infant seat of FIG. 1.

Referring now to the drawings, wherein like reference numerals represent identical corresponding parts throughout the several views, and more particularly to FIGS. 1, 2, 4 and 5 thereof, the infant seat of the present invention is indicated generally by reference numeral 10. Infant seat 10 is shown in the Figures as being cantilever mounted and self-adjustably clamped to a horizontally disposed tabletop A.

The infant seat 10 includes a generally vertically oriented seat back 12 which is pivotally mounted at a lower side 14 to the rear side 16 of a generally horizontally oriented seat bottom 18. Typically, both seat back 12 and seat bottom 18 are made of an injection molded plastic. They can, however be made of any other rigid material. Seat back 12 has a plurality of spaced-apart projections 20 extending from lower side 14 which align with and fit into a plurality of spaced-apart openings 22 formed along the rear side 16 of the seat bottom 18. Axially aligned holes 23 laterally traverse projections 20 and openings 22 to accommodate retention pins 24, thereby providing pivotable engagement between seat back 12 and seat bottom 18.

Extending along opposed sides of infant seat 12 is a pair of spaced-apart support members 26. Support members 26 are substantially tubular in structure and generally of a U-shape. Each support member 26 has an upper portion which substantially comprises an upper support arm 28, and a bottom portion which substantially comprises a bottom support arm 30. Upper support arm 28 and bottom support arm 30 are generally parallel to one another, but lower support arm 30 is longer than upper support arm 28 and includes an upwardly extending end section 32. Bumpers 34 and 35 are respectively affixed to the distal ends of upper support arm 28 and upperwardly extending end section 32 of lower support arm 30. Typically, bumpers 34 and 35 are of molded rubber or plastic. Each upper support arm 28 is adapted for engagement of bumper 34 with an upper surface B of tabletop A, while lower support arm 30 is adapted for engagement of bumper 35 with an under surface C of tabletop A. Since lower support arm 30 is longer than upper support arm 28, it engages the tabletop A at a location farther from the tabletop edge than does upper support arm 28.

A first connector member 36 is attached to each upper support arm 28 and extends downwardly therefrom. A second connector member 38 is attached to each lower support arm 30 and extends upwardly therefrom and is in axial alignment with a first connector member 36. A third connector 40 is axially aligned with first and second connectors 36 and 38, and by conventional means is in rotatable engagement with the ends of the first and second connectors 36 and 38. Typically, the ends of first and second connectors 36 and 38 are reduced in diameter so as to enter into and rotably engage the ends of third connector 40. Connectors 36, 38 and 40 are each tubular or rod-like in form.

Extending between and attached to each third connector member 40 is a cross member 42. Cross member 42 is tubular in form and generally U-like in shape with the arms of the U shorter than the base of the U. The base portion of cross member 42, which is designated as 44, is positioned within a longitudinal opening 46 of seat bottom 18. Elongated opening 46 is positioned towards a forward side 41 of seat bottom 18. Thus, while cross member 42 frictionally engages seat bottom 18 along opening 46, the engagement is such that seat bottom 18 is pivotable about base portion 44 of cross member 42.

Figure 4:
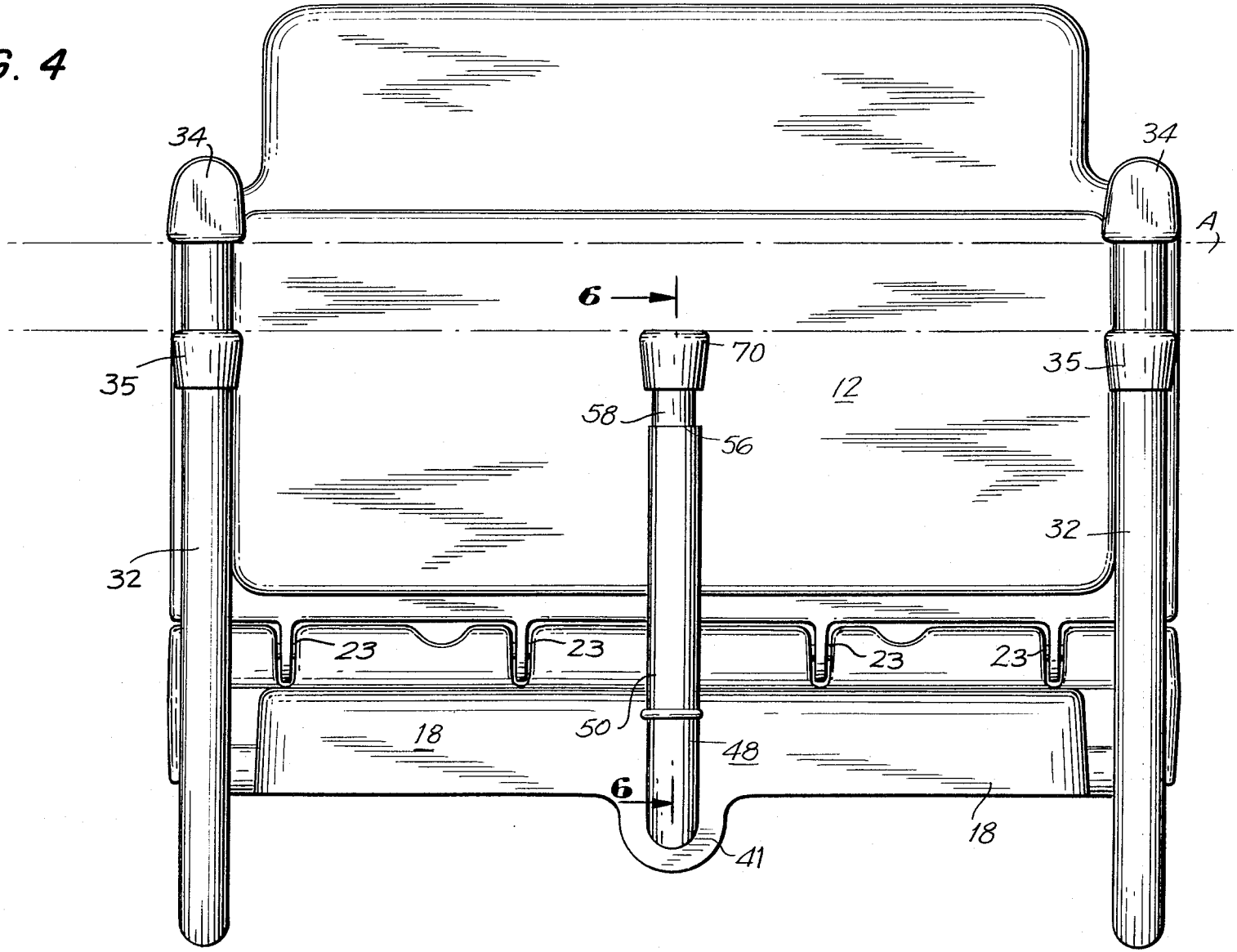
FIG. 4 is a front elevational view of the infant seat FIG. 1.
Figure 5:
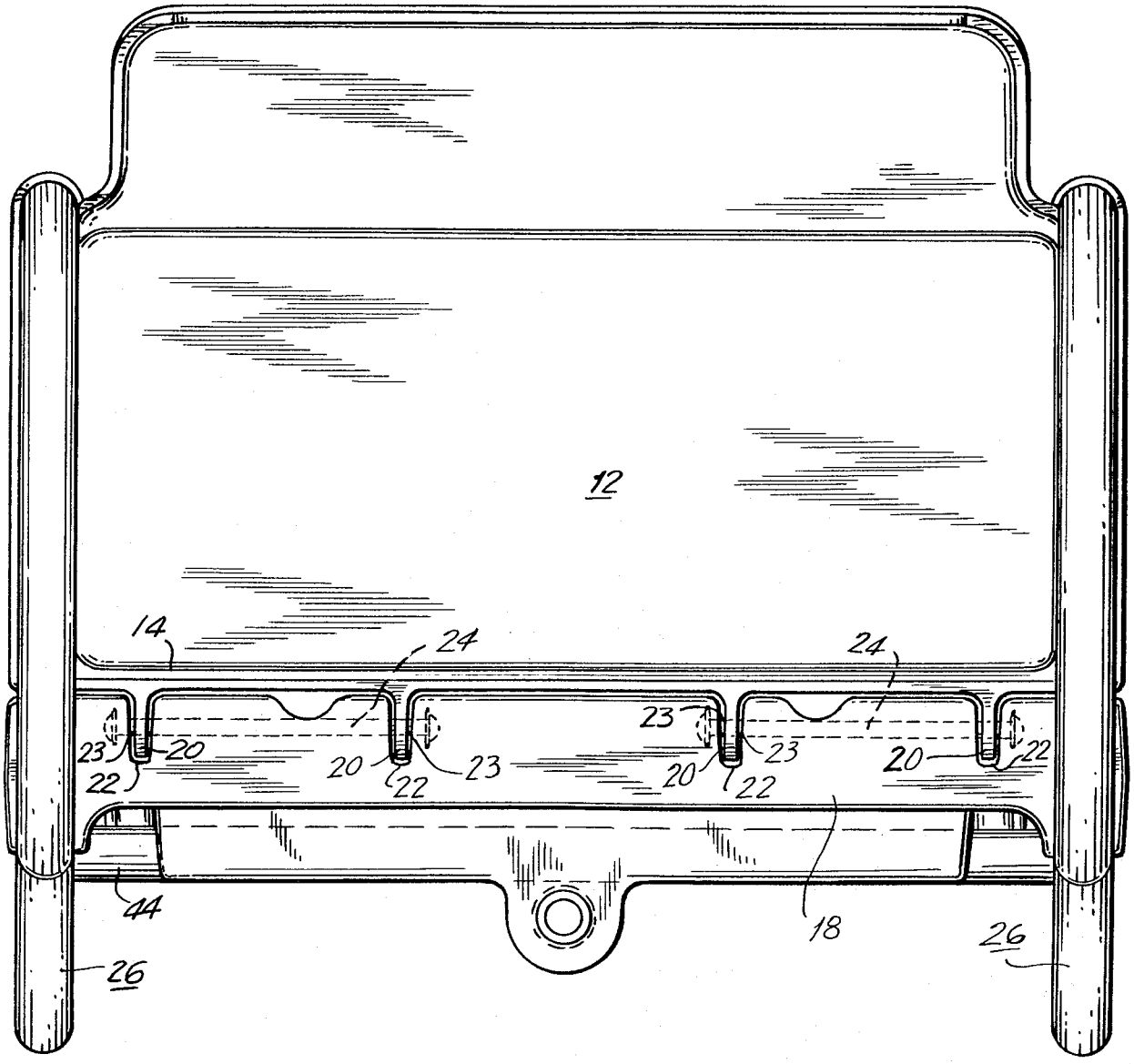
FIG. 5 is a rear elavational view of the infant seat of FIG. 1.

A clamping support arm assembly is generally designated as 48. Assembly 48 includes a generally L-shaped member 50 which extends outwardly and upperwardly from forward side 41 of seat bottom 18. L-shaped member 50 is permanently attached to seat bottom 18 by conventional means, such as by being molded therein. Annular projections 54 can be formed on L-shaped member 50, as shown in FIG. 1, to assist in retention of the member 50 to bottom seat 18. It is anticipated by the present invention that to assure secure attachment of L-shaped member 50 to seat bottom 18, member 50 should be sufficiently surrounded by seat bottom 18. This contingency can result in a downward bulging of seat bottom 18, as shown in FIG. 4. L-shaped member 50 extends from the seat bottom 18 at a location approximately midway along the length of forward side 41 of seat bottom 18. Furthermore, L-shaped member 50 is tubular in form and has a distal end 56.

A telescoping member 58 in conjunction with spring means 60, such as a helical spring 60 as shown in FIG. 6, is capable of extensible and retractable movement within L-shaped member 50 about distal end 56. Telescoping member 58 is tubular in form, with its outside diameter smaller than the inside diameter of L-shaped member 50, thereby allowing it to slide in and out of distal end 56 of L-shaped member 50. Spring 60 is affixed by conventional means at an end thereof to L-shaped member 50 and is affixed at its opposite end to the telescoping member 58. Attachment of spring 60 to L-shaped member 50 and telescoping member 58 can be by any number of conventional means. However, in describing the present invention, it is anticipated that spring 60 is attached to L-shaped member 50 by an enlarged end coil 62 which mates with an annular boss 64 in L-shaped member 50. In contrast, the opposite end of spring 60 has a coil 66 of reduced diameter so that it mates with an angular grove 68 formed in telescoping member 58. Spring 60 tends to push the telescoping member 58 outwardly from the distal end 56. A bumper 70, either of rubber or plastic, is affixed to a distal end 59 of telescoping member 58.

When mounted on a tabletop A, telescoping member 58 engages the under surface C of the tabletop, while upper end support arm 28 engages the upper surface B of the tabletop. The engagement of upper support arm 28 and telescoping member 58 to these surfaces is along a common plane substantially perpendicular to the surfaces B and C. In its engagement with under surface C, telescoping member 58 exerts an upward force on surface C. This force is the result of telescoping member 58 being baised by spring 60. The upward force of telescoping member 58 in cooperation with the engagement of upper support arm 28 on upper surface B (all of which occurs in a common plan) results in the clamping engagement of the present invention to tabletop A. Furthermore, since telescoping member 58 is extensible and retractable in it movement about distal end 56, this clamping engagement can be provided to tabletops of different thicknesses. It is anticipated by the present invention that infant seat 10 can accommodate tabletops of three-quarters of an inch to about 2 inches in thickness, Seat back 12 includes a pair of spaced-apart grooves 72. One of each grooves 72 is formed on a side of seat back 12 and includes at least one shoulder which frictionally engages upper arm support 28. Such engagement provides releasable attachment of said seat back 12 to the pair of spaced-apart support members 26. Likewise, seat bottom 18 is provided with a pair of spaced-apart grooves 74. Grooves 74 are disposed towards the rear of seat bottom 18, but at opposite sides thereof. Each groove 74 has at least one shoulder which frictionally engages the lower support arm 30, thereby providing releasable attachment of seat bottom 18 to the pair of spaced-apart support members 26. When seat back 12 and seat bottom 18 engage spaced-apart support members 26 as described, the infant seat 10 is in its opened state and when thus mounted to a tabletop, seat back 12 is in a generally vertical orientation and seat bottom 18 is in a generally horizontal orientation.

In the operation of the present invention, infant seat 10 is placed in its opened state as shown in FIGS. 1, 2, 4 and 6, by rotating the spaced-apart support members 26 approximately 90° about third connector member 40 such that the support members are parallel to each other. Once in a parallel position, seat back 12 and seat bottom 18 can be releasably locked in position to the support members 26 by means of grooves 72 and 74 respectively. The infant seat 10 is then slid onto tabletop A so that upper support arm 28 and lower support arm 30 provide cantilever mounting to the tabletop. Furthermore, the interaction of upper support arm 28 and L-shaped member 50, which engage upper and under surfaces of the tabletop A respectively, provides self-adjustable clamping of the infant seat 10 to tabletop A.

FIG. 3 shows the infant seat 10 of the present invention in its folded state. To fold infant seat 10, a user would provide a forwardly directed force to seat back 12 thereby overcoming its frictional attachment to spaced-apart support members 26. Seat back 12 is then pivoted about pins 24 and onto seat bottom 18. Thereafter, an upwardly directed force is applied to seat bottom 18 to overcome its frictional attachment to spaced-apart support members 26. Both seat back 12 and seat bottom 18 are then placed in a vertical position as shown by the phantom lines on FIG. 1. The spaced-apart support members 26 are then rotated inwardly approximately 90° about the third connector members 40 so that support members 26 fold onto one another as shown in FIG. 3. In its folded state the infant seat 10 is compact and idealy suited for storage.

Member 50 of the present invention has been shown for purposed of describing the present invention as being of a generally L-shape. However, it is anticipated by the present invention that member 50 can vary somewhat in its configuration, such as being acurate in shape.

While the invention has been described with respect to a specific embodiement, it is not limited thereto. The appended claims therefore are intended to be construed to encompass all forms and embodiments of the invention, within its true and full scope, whether or not such forms and embodiments are expressed herein.

What is claimed is:

1. An infant seat for cantilever mounting to a horizontally disposed tabletop and self-adjustable clamping to such tabletop comprising:

a seat back pivotably connected, at a lower side thereof, to a rear side of a seat bottom;

a pair of spaced-apart support members, each said support member integral in structure and having a top portion adapted as an upper support arm and a bottom portion adapted as a lower support arm, said lower support arm longer than said upper support arm, said lower support arm adapted to engage an under surface of a tabletop and said upper support arm adapted to engage an upper surface of the tabletop for cantilever mounting to the tabletop;

a first connector member affixed to each said upper support arm and disposed downwardly therefrom;

a second connector member affixed to and upwardly disposed from each said lower support arm, said second connenector member in axial alignment with said first connector member;

a third connector member in axial alignment with each said first and second connector member and in rotatable engagement therewith;

a cross member extending between and affixed to each said third connector member, said seat bottom pivotably attached to said cross member at a location on said seat bottom forward of its pivotable attachment to said seat back; and a clamping support arm assembly affixed to said seat bottom, said clamping support arm assembly having a member projecting generally outwardly and upwardly as it extends from a forward side of said seat bottom and a means associated with said outwardly and upwardly projecting member for self-adjustable engagement of the under surface of the tabletop, said self-adjustable means adapted to exert a force against the under surface of the tabletop, this force in cooperation with the engagement of the upper support arm on the upper tabletop surface provides clamping engagement to the tabletop.

2. The infant seat as recited in claim 1, wherein said self-adjustable means is a telescoping member in cooperation with a resilient means, said resilient means disposed in said outwardly and upwardly extending member and attached thereto such that said telescoping member is capable of extensible and retractable movement about a distal end of said outwardly and upwardly extending member, thereby said telescoping member is capable of self-adjustable engagement with the under surface of tabletops having various thicknesses.

3. The infant seat as recited in claim 2, wherein said resilient means is a helical spring.

4. The infant seat as recited in claim 2, wherein said telescoping member has a bumper means affixed at its end, said bumper means adapted to engage directly onto a tabletop surface.

5. The infant seat as recited in claim 1, wherein the end of each upper support arms and each lower support arms have bumper means affixed thereto.

6. The infant seat as recited in claim 1, wherein said seat back includes means for releasably attaching said seat back, to said pair of spaced-apart support members.

7. The infant seat as recited in claim 6, wherein said releasably attaching means is a pair of spaced-apart grooves, each groove at an opposite side of said seat back for engagement with a support member said grooves each having at least one shoulder which frictionally engages said support member thereby providing releasable attachment of said seat back to said support member.

8. The infant seat as recited in claim 1, wherein said seat bottom includes means for releasably attaching said seat bottom, to said pair of spaced-apart support member.

9. The infant seat as recited in claim 8, wherein said releasably attaching means in a pair of spaced-apart grooves, each groove at an opposite side of said seat bottom for engagement with a support member, said grooves each having at least one shoulder which frictionally engages said support member, thereby providing releasable attachment of said seat bottom to said support member.

10. The infant seat as recited in claim 1, wherein said outwardly and upperly projecting member is generally L-shaped.

11. The infant seat as recited in claim 1, wherein said self-adjusting means is adapted to engage the under surface of a tabletop at a location opposite the location on the upper tabletop surface which is approximately midway between engagement locations of said upper support arms.

12. The infant seat as recited in claim 1, in a folded position, wherein:

said seat back is pivotably folded onto said seat bottom and the combination of said seat back and said seat bottom is pivoted about said cross member into a substantially upright position; and said pair of spaced-apart support members in association with their respective first and second connector members is pivoted about said third connector members and towards said upright positioned seat back and seat bottom so that said support members fold onto one another.

13. The infant seat as recited in claim 1, wherein said first, second and third connector members are tubular in configuration.

14. The infant seat as recited in claim 1, wherein said self-adjustable means and said upper support arms are capable of engagement with the bottom surface and the top surface of the tabletop respectively, the engagement of said upper support arm to the top surface of a tabletop and the engagement of said self-adjustable mean to the bottom surface of a tabletop are in alignment with each other along a plane extending substantially perpendicularly through the top and bottom tabletop surfaces.

* * * * *